United States Patent [19]

Podgor

[11] Patent Number: 4,749,196

[45] Date of Patent: Jun. 7, 1988

[54] CLUB AND HEAD FOR PUTTING

[76] Inventor: Joseph E. Podgor, 1107 Gardens Plz. Park Place & Beach, Ocean City, N.J. 08226

[21] Appl. No.: 14,400

[22] Filed: Feb. 13, 1987

[51] Int. Cl.[4] ..... A63B 69/36

[52] U.S. Cl. ..... 273/164; 273/186 A; 273/DIG. 14

[58] Field of Search ..... 273/163 R, 163 A, 162 B, 273/164, 183 E, 183 D, 186 A, 194 R, 194 A, 168, 78; 33/263, 275, 286, 508, 533

[56] References Cited

U.S. PATENT DOCUMENTS

| | | | |
|---|---|---|---|
| 1,454,267 | 5/1923 | Challis et al. | 273/164 |
| 1,556,062 | 10/1925 | Baugh | 273/163 R |
| 2,414,733 | 1/1947 | Fuchs | 33/286 |
| 4,222,566 | 9/1980 | Berry | 273/164 |
| 4,343,472 | 8/1982 | Hamilton | 273/164 |
| 4,367,877 | 1/1983 | Gibson et al. | 273/164 |

*Primary Examiner*—George J. Marlo
*Attorney, Agent, or Firm*—Stanley Bilker

[57] ABSTRACT

An alignment element for a golf club formed of a transparent material having first and second references marks. The reference marks are oriented upon the element so that when the element is affixed to a golf club, preferably a putter, the second reference mark is magnified when the first reference mark is oriented between the viewer and the second reference mark. Preferably the second reference mark is a contrasting color, lighter than the first reference to give the appearance, when viewed from above, of a darker line superimposed on a lighter magnified line. When affixed to a golf club, the alignment of the first reference mark with the magnified second reference mark is used to assist in positioning when addressing the ball.

20 Claims, 1 Drawing Sheet

FIG. 1
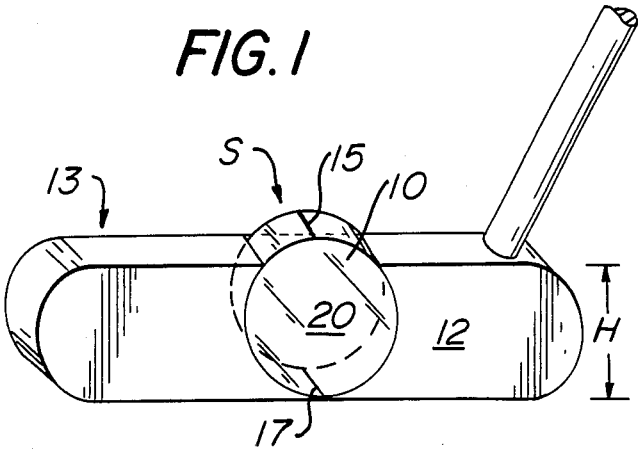
FIG. 2
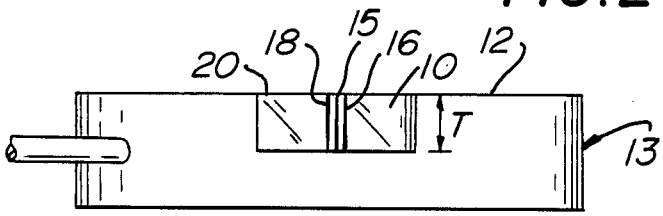
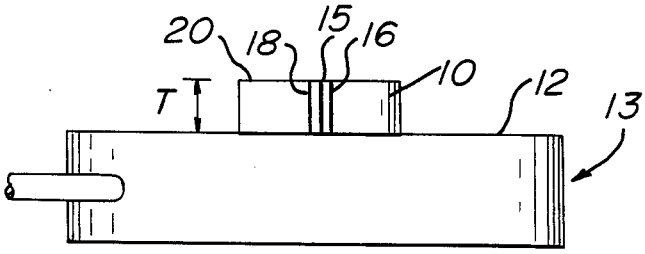
FIG. 4
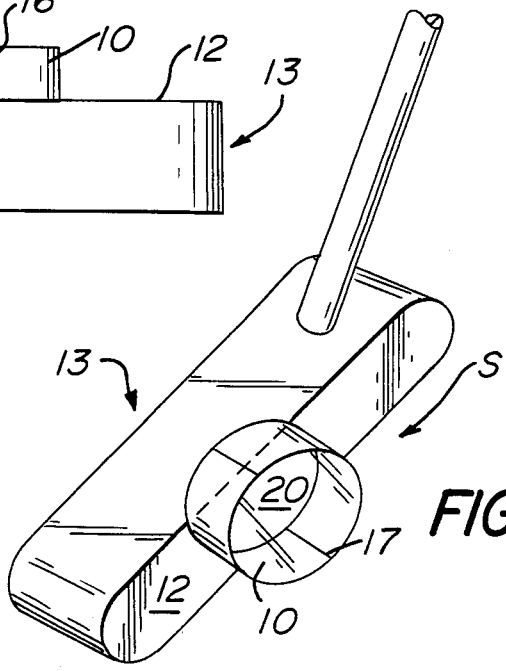
FIG. 3

CLUB AND HEAD FOR PUTTING

BACKGROUND OF THE INVENTION

Numerous types of golf putters are available for use in the game of golf. The design of a golf putter and the theory of its use vary widely. Golf putters which include some type of alignment means are available. The available alignment means include a simple line etched in the top surface of the putter or in the bottom surface of a transparent putter. In U.S. Pat. No. 1,454,267, a line perpendicular to the putter club face is formed in a transparent putter. Other more complex sighting means are known. U.S. Pat. Nos. 2,929,631 and 3,468,545 include a small lens surface to be used with a club head having lines of two different colors. The lens' surface is corrugated such that as the viewing angle changes, the color seen changes. This allows the golfer to be more consistent in the positioning while addressing the ball. The golf putters of U.S. Pat. Nos. 4,569,524; 4,222,566; 3,866,922; 4,519,612; 3,273,891 and U.S. Pat. No. Des. 205,041 include some form of alignment indicator either embedded in a transparent head or inserted in or affixed to the surface of a golf putter. A transparent golf putter with its vertical edges rendered opaque to aid in alignment when addressing the ball is shown in U.S. Pat. No. 4,369,974.

SUMMARY OF THE INVENTION

The present invention provides a visual alignment aid primarily adapted for use with a golf putter which is inexpensive to manufacture and can be easily affixed to an existing putter or form an integral part of a new putter. The alignment device comprises a translucent or transparent magnifying element, typically having the shape of a cylindrical disk. The element includes a first line on the edge of the disk which is parallel to the longitudinal axis of the cylinder and a second line on the edge of the disk which is oriented approximately 180° around the disk from the first line and is also parallel to the longitudinal axis of the cylinder. The first and second lines are preferably of contrasting color such as black and white or black and fluorescent yellow. This orientation of lines on a disk provides that the second line is magnified by the disk when viewed from a position orienting the first line between the second line and the viewer. Thus, a golfer having such a device affixed to a putter with the second line adjacent the club foot is able to view the magnified second line from above and use the orientation of the single line with respect to the magnified second line to assist in body and club alignment in addressing the ball. The use of a first line superimposed upon the magnified second line, when viewed from above, allows the golfer to easily and consistently vary the orientation of the putter head and the golfer's body depending upon the length of the putt attempted.

BRIEF DESCRIPTION OF THE DRAWINGS

FIG. 1 is a perspective view of the preferred embodiment of the present invention.

FIG. 2 is a top plan view of the preferred embodiment of the present invention.

FIG. 3 is a perspective view of an alternate embodiment of the present invention.

FIG. 4 is a top plan view of the alternate embodiment shown in FIG. 3.

DETAILED DESCRIPTION OF THE PREFERRED EMBODIMENT

The golf club with sight device of the present invention is shown in a preferred embodiment in FIGS. 1 and 2 and in an alternate embodiment in FIGS. 3 and 4. In the preferred embodiment, FIGS. 1 and 2, the sighting device S comprises a cylindrical disk 10 having a diameter approximately the height H of the putter face 12. This diameter is typically between 1 ½ and 2 ½ inches (3.8 to 6.4 cm). The thickness T of the disk 10 is typically about ½ inch (approximately 13 mm). The dimensions of the disk may easily be varied depending upon the dimensions and style of the putter with which the disk 10 is to be employed.

Disk 10 is provided with a first line 15 on the cylinder's edge. Line 15 is oriented parallel to the longitudinal axis of the cylinder. The disk 10 is further provided with a second line 17 oriented on the edge of the disk 10, parallel to the longitudinal axis of the cylinder. The second line 17 is preferably oriented 180° around the disk 10 from line 15. The second line 17 is preferably the same thickness as line 15, for example approximately 1/16 of an inch (approximately 2 mm). The disk 10 is oriented on the putter head 13, either on the club face 12 as shown in the Figures or on the back of the club (not shown). The disk 10 is oriented on the club head 13 such that the first line 15 is located vertically above the second line 17 when the putter head 13 is parallel to the ground. Disk 10 may be embedded in the putter head 12 such that the exposed top 20 of the disk 10 and the putter face 12 form a continuous substantially planar surface, FIG. 2. Alternatively, the disk 10 may be affixed by any appropriate means, to the putter face 12, protruding therefrom as shown in FIGS. 3 and 4.

Orientation of the disk 10 on the putter head 12 allows a golfer to align the first line 15 and the second line 17 when addressing the ball to putt. The curvature of the disk 10 provides for a magnification of the second line 17 when viewed through the disk. This magnification results in second line 17, when viewed through the disk 10, taking on the appearance of a thick line having outer edges 16 land 18. To aid in viewing, first line 15 and second line 17 are preferably formed in contrasting colors. For example line 15 may be black and line 17 white or fluorescent yellow. When viewed from above (FIGS. 2 and 4) such a combination has the appearance of a relatively wide white or fluorescent yellow line defined by edges 16 land 18 with a relatively thin dark line 15 superimposed thereon. The use of a first line superimposed upon a magnified second line allows the golfer to improve consistency in lining up a golf putt.

Lines 15 and 17 are oriented perpendicular to the top surface 20 of the disk 10 and putter face 12 to assist in positioning the putter for the desired direction of the putt. Viewing the lines from above, orientation of the sight of line 15 with the edges 16 and 18 of magnified line 17 allows the golfer to be consistent in body positioning with respect to the distance of the putter head from the golfer's body during putting to adjust for the length of the putt attempted. For example, line 15 can be aligned so that it appear to be centered between edges 16 and 18 of magnified line 17, in the golfer's view, for a particular distance to be putted. For a longer putt where, a greater distance between the golfer's body and the putter head is desired, line 15 can be aligned with outer edge 18, in the golfer's view, or in any desired position between the centered position and edge 18. Conversely, for shorter putts, line 15 can be aligned with edge 16, in the golfer's view, or in any position between the centered position and edge 16. With a minimum of experimentation, the golfer will become proficient at judging the desired alignment of line 15 and edges 16 and 18 of magnified line 17 for the distance to be putted. Use of the sight device of the present invention allows a golfer to be more consistent in positioning when addressing the ball for a putt thereby increasing putting accuracy.

The disk 10 is preferably a transparent or translucent material such as glass or plastic. Further, the cylindrical disk shape may be altered to provide any desired degree of magnification desired.

It will therefore be understood that various changes in the invention which has herein been described and illustrated in order to explain the nature of the invention may be made by those skilled in the art within the principal and scope of the invention as expressed in the following claims.

What is claimed is:

1. In combination with a golf club, visual alignment means comprising a transparent alignment element mounted upon the club head and having a generally cylindrical upper surface, a first reference mark on the upper cylindrical surface and a second reference mark on a lower surface opposite thereto, said reference marks being oriented such that said transparent element magnifies said second reference mark when viewed from a position above whereby said first reference mark may be adjustably disposed between a viewer and said second reference mark in a direction aligned with an intended target.

2. The alignment means of claim 1, wherein said first reference mark is upon the first upper surface of said transparent alignment element and said second reference mark is on a second lower surface of said transparent alignment element.

3. The visual alignment means of claim 1, wherein said transparent alignment element is a cylindrical disk shape.

4. The visual alignment means of claim 1, wherein said first reference mark and said second reference mark are formed in contrasting colors.

5. The visual alignment means of claim 4, wherein said contrasting colors are black and white.

6. The visual alignment means of claim 4, wherein said contrasting colors are black and fluorescent yellow.

7. The visual alignment means of claim 1, wherein said transparent alignment element is attached to a a rear surface of a golf putter.

8. The visual alignment means of claim 1, wherein said transparent alignment element is embedded in a golf putter face forming a part of a ball striking surface of said putter.

9. The visual alignment means of claim 1, wherein said transparent alignment element is affixed to a front surface of a golf club.

10. In combination with a golf putter having a head for stroking a ball and a shaft for addressing the head with respect thereto, an alignment device comprising a sighting disk having a transparent cylindrical surface included between opposing light transmitting surfaces, first and second reference marks oriented on said cylindrical surface at diametrically opposed portions thereto, said disk being mounted on the putter head so that the second reference mark when viewed through the cylindrical surface from above is magnified widthwise with respect to the first reference mark for adjustable orientation therewith whereby the putting face may be easily aligned with an intended target.

11. The alignment device of claim 10 whereby the first and second reference marks are lines transverse to the cylindrical surface.

12. The alignment device of claim 11 wherein said first and second reference marks are lines of different colors.

13. The alignment device of claim 10 wherein said disk comprises a right angle cylinder having plane parallel faces.

14. The alignment device of claim 13 wherein said disk is mounted upon the front face of the putter.

15. The alignment device of claim 13 wherein said disk is recessed within the putter head.

16. The alignment device of claim 15 wherein one of the parallel faces of the cylinder is flush with the putter face.

17. The alignment device of claim 13 wherein said disk is mounted on the rear face of the putter.

18. A head for a golf putter comprising a transparent portion having first and second reference marks on respective upper and lower surfaces thereof, the upper surface of the transparent portion being substantially cylindrical and having a longitudinal axis generally perpendicular to the stroking face of the putter, said second reference mark being magnified widthwise with respect to the first reference mark when viewed from above for adjustable orientation therewith whereby the putter stroking face may be readily aligned toward an intended target.

19. The golf putter head of claim 18 wherein the first and second reference marks comprise substantially equal width lines of different colors so that the first reference line may be laterally superimposed into adjustable registration on the magnified width of the second reference line.

20. The golf putter head of claim 19 wherein the transparent portion comprises a detachable disk.

* * * * *